US008019605B2

(12) United States Patent
Agapi et al.

(10) Patent No.: US 8,019,605 B2
(45) Date of Patent: Sep. 13, 2011

(54) REDUCING RECORDING TIME WHEN CONSTRUCTING A CONCATENATIVE TTS VOICE USING A REDUCED SCRIPT AND PRE-RECORDED SPEECH ASSETS

(75) Inventors: Ciprian Agapi, Lake Worth, FL (US); Oscar J. Blass, Boynton Beach, FL (US); Paritosh D. Patel, Parkland, FL (US); Roberto Vila, Hollywood, FL (US)

(73) Assignee: Nuance Communications, Inc., Burlington, MA (US)

( * ) Notice: Subject to any disclaimer, the term of this patent is extended or adjusted under 35 U.S.C. 154(b) by 1156 days.

(21) Appl. No.: 11/748,256

(22) Filed: May 14, 2007

(65) Prior Publication Data

US 2008/0288256 A1 Nov. 20, 2008

(51) Int. Cl.
*G10L 13/08* (2006.01)
*G10L 13/06* (2006.01)

(52) U.S. Cl. ..... 704/260; 704/267; 704/258

(58) Field of Classification Search ..... 704/260
See application file for complete search history.

(56) References Cited

U.S. PATENT DOCUMENTS

| | | | | |
|---|---|---|---|---|
| 6,173,263 | B1 * | 1/2001 | Conkie | 704/260 |
| 6,539,354 | B1 * | 3/2003 | Sutton et al. | 704/260 |
| 2003/0028380 | A1 * | 2/2003 | Freeland et al. | 704/260 |

* cited by examiner

*Primary Examiner* — Talivaldis Ivars Smits
*Assistant Examiner* — Farzad Kazeminezhad
(74) *Attorney, Agent, or Firm* — Wolf, Greenfield & Sacks, P.C.

(57) ABSTRACT

The present invention discloses a system and a method for creating a reduced script, which is read by a voice talent to create a concatenative text-to-speech (TTS) voice. The method can automatically process pre-recorded audio to derive speech assets for a concatenative TTS voice. The pre-recording audio can include sets of recorded phrases used by a speech user interface (Sill). A set of unfulfilled speech assets needed for foil phonetic coverage of the concatenative TTS voice can be determined. A reduced script can be constructed that includes a set of phrases, which when read by a voice talent result in a reduced corpus. When the reduced corpus is automatically processed, a reduced set of speech assets result. The reduced set includes each of the unfulfilled speech assets. When this reduced corpus is combined with existing speech assets the result will be a voice with a complete set of speech assets.

15 Claims, 3 Drawing Sheets

REDUCING RECORDING TIME WHEN CONSTRUCTING A CONCATENATIVE TTS VOICE USING A REDUCED SCRIPT AND PRE-RECORDED SPEECH ASSETS

BACKGROUND

1. Field of the Invention

The present invention relates to the field of concatenative text-to-speech (TTS) voice generation and, mote particularly, to reducing recording time when constructing a concatenative TTS voice using a reduced script and pre-recorded speech assets.

2. Description of the Related Art

Concatenative text-to-speech (TTS) synthesis is based on a concatenation of units of recorded speech. Generally, concatenative TTS systems produce more natural-sounding speech than other synthesis methods, such as formant synthesis. Three main sub-types of concatenative synthesis include diphone synthesis, domain specific synthesis, and unit selection synthesis.

Diphone synthesis uses a minimal speech database containing all the diphones occurring in a language. Only one example of each diphone is contained in a diphone synthesis database. At runtime, target prosody of a sentence is superposed on the diphone units using digital signal processing (DSP) techniques. Diphone synthesis suffers from sonic abnormalities, which are especially pronounced at boundary or splice points. Abnormalities are caused by differences in pitch, volume, time shifting, and other speech characteristics. Few commercial programs use diphone synthesis because it produces results that sound significantly less natural (approximately equivalent to formant results) than other concatenative TTS sub-types and it lacks the robust customization of formant synthesis techniques.

Domain-specific synthesis concatenates prerecorded words and phrases to create complete utterances. Domain-specific synthesis is often used in applications having limited output options. Output quality of domain-specific synthesis can be very high, but vocabulary breadth for domain-specific syntheses can be low. As a size of the domain-specific synthesis increases, the set of needed phrases geometrically increases. When a needed vocabulary is large, a synthesis technique capable of generating an unlimited vocabulary (such as unit selection synthesis) should be used in place of domain-specific synthesis.

Unit selection synthesis relies on corpus of recorded speech. This corpus is used to create a database of speech assets that together represent a concatenative TTS voice. During database creation, each recorded utterance is segmented into one or more units of varying size, which include phones, syllables, morphemes, words, phrases, and sentences. Each unit in the database is indexed based on acoustic parameters that can include pitch, duration, power, position in a syllable, neighboring phones, and/or the like. At runtime, a desired utterance is produced by determining a best set of candidate units from the database. The determination is typically based using one or more weighted decision trees. The output from the best unit-selection systems is often indistinguishable from real human voices, especially in contexts for which the TTS system has been tuned. A vocabulary of unit selection synthesis is unlimited so long as enough units of speech are provided for a complete phonetic coverage. Maximum naturalness typically requires unit selection speech databases to be very large. In many natural sounding unit selection synthesis systems, gigabytes of storage are needed for the recorded units of speech. In some circumstances, compression technologies can reduce an amount of needed storage space for unit selection synthesis to more manageable sizes. A minimum recording time of dozens of hours may be required to generate speech recordings for a concatenative TTS voice (for unit selection synthesis).

Accordingly, considerable development effort and cost is required to record a speech and then to process the recorded speech to generate speech assets needed for full phonetic coverage of a single TTS voice (for unit selection synthesis). This effort must be repeated for every concatenative TTS voice generated. Many parties interested in creating custom TTS voices, such as custom voices for a telematics system, often find the cost of creating new voices prohibitive. Additionally, uniform recording conditions are necessary to generate a clean speech corpus. Conventionally, a voice talent reads a reference script in a recording studio, where the reference script is specifically constructed to result in a speech corpus that produces a TTS voice having full phonetic coverage. Costs of producing a TTS voice for unit selection synthesis would be substantially lower if the size of the script, which the voice talent speaks, was minimized.

SUMMARY OF THE INVENTION

The present invention minimizes a size of script needed to produce a concatenative TTS voice by leveraging speech assets produced from pre-recorded speech segments. The leveraged assets can be called pre-recorded assets. In the invention, instead of needing a voice talent to read a reference script the voice talent only needs to read a reduced version of the reference script called a reduced script, which saves recording time and minimizes recording costs. The reference script can be a script able to produce a complete phonetic set of assets, which is also referred to as reference assets. Speech assets resulting from the reduced script can be referred to as reduced assets. The reduced script must include a set of phrases, such that the union of the reduced assets and the pre-recorded assets includes the reference assets. At the same time, a minimal set of phrases should be included in the reduced script to minimize recording time and recording costs. At a minimum, an intersection of the pre-recorded assets and the reference assets (also called common assets) plus the reduced assets should provide full phonetic coverage for a TTS voice.

In one embodiment of the invention, all pre-recorded speech by a voice talent can be processed by a speech recognizer to produce the pre-recorded assets. The pre-recorded speech can include recordings used as part of a speech user interface (SUI). The pre-recorded speech assets can be compared against the reference assets to generate an unfulfilled set of assets. The unfulfilled set can mathematically be a result obtained by subtracting the pre-recorded assets from the reference assets.

Each phrase in the reference script can be associated with one or more reference assets. The reduced script can be a subset of the reference. Each phrase in the reduced script can have acoustic characteristics needed to generate the unfulfilled set of assets. An inverse relationship can exist between a size of the reference script and a size of a set of common assets, which are the intersection of the reference assets and the pre-recorded assets. Consequently, when a set of assets represented by the common assets is relatively large, a size difference between the reduced script and the reference script can be relatively large.

The present invention can be implemented in accordance with numerous aspects consistent with the material presented herein. For example, one aspect of the present invention can include a method for creating a reduced script, which is read by a voice talent to create a concatenative TTS voice. The method can automatically process pre-recorded audio to derive speech assets for a concatenative TTS voice. In one embodiment, the pre-recording audio can include a set of recorded phrases used by a speech user interface (SUI). A set of unfulfilled speech assets needed for full phonetic coverage of the concatenative TTS voice can then be determined. Next, a reduced script can be constructed that includes a set of phrases, which when read by a voice talent, results in a reduced recording. When the reduced recording is processed, a reduced set of speech assets result. This reduced set includes each of the unfulfilled speech assets.

Another aspect of the present invention can include a system for minimizing recording time needed for creating a concatenative TTS voice. The system can include a recognizer and a reduced script construction engine. The recognizer can generate speech assets from audio recordings containing speech. The recognizer can receive pre-recorded audio that includes recorded phrases used by a speech user interface to generate a pre-recorded set of speech assets. The reduced script construction engine can generate a reduced script that is able to produce a reduced set of speech assets. Combining the reduced set with the pre-recorded set results in a unit selective synthesis concatenative TTS voice that has complete phonetic coverage. The reduced script construction engine can be optimized to minimize redundancy in phonetic coverage between the pre-recorded set and the reduced set.

Still another aspect of the present invention can include a reduced concatenative text-to-speech (TTS) script for use in generating a concatenative text-to-speech voice. The reduced script can be an automatically generated document that includes a minimal set of phrases to be spoken by a voice talent to generate a reduced recording. The reduced recording is able to be processed by a speech recognition processor to generate a reduced set of concatenative TTS assets. A union of the reduced set and a pre-recorded set of concatenative TTS assets results in a complete set of TTS assets needed for a complete concatenative TTS voice. The pre-recorded set can be generated from pre-recorded audio, such as audio recorded for SUI interactions.

It should be noted that various aspects of the invention can be implemented as a program for controlling computing equipment to implement the functions described herein, or as a program for enabling computing equipment to perform processes corresponding to the steps disclosed herein. This program may be provided by storing the program in a magnetic disk, an optical disk, a semiconductor memory, or any other recording medium. The program can also be provided as a digitally encoded signal conveyed via a carrier wave. The described program can be a single program or can be implemented as multiple subprograms, each of which interact within a single computing device or interact in a distributed fashion across a network space.

It should also be noted that the methods detailed herein can also be methods performed at least in part by a service agent and/or a machine manipulated by a service agent in response to a service request.

BRIEF DESCRIPTION OF THE DRAWINGS

There are shown in the drawings, embodiments which are presently preferred, it being understood, however, that the invention is not limited to the precise arrangements and instrumentalities shown.

DETAILED DESCRIPTION OF THE INVENTION

Figure 1:
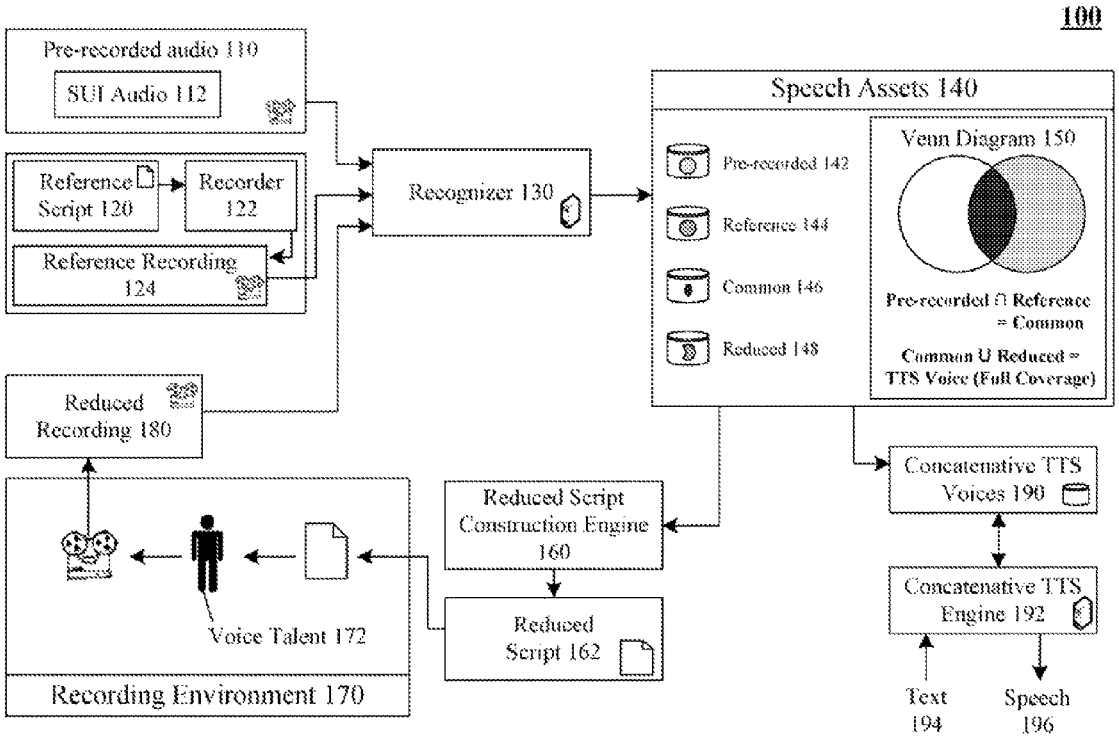
FIG. 1 is a schematic diagram of a system for minimizing recording time when creating a concatenative text-to-speech (TTS) voice using a reduced script in accordance with an embodiment of the inventive arrangements disclosed herein.

FIG. 1 is a schematic diagram of a system 100 for minimizing recording time when creating a concatenative text-to-speech (TTS) voice using a reduced script 162 in accordance with an embodiment of the inventive arrangements disclosed herein. In system 100, pre-recorded audio 110 containing speech by a voice talent 172 can be processed through a recognizer 130 to generate a set of speech assets 140 (e.g., pre-recorded assets 142). The pre-recorded assets 142 can be compared against a set of reference assets 144, which provide full phonetic coverage for a concatenative TTS voice. The reference assets 144 can be assets resulting from passing a reference recording 124 through the recognizer 130. The reference recording 124 can be audio captured by a recorder 122 based upon a reading of a reference script 120. An intersection of the pre-recorded assets 142 and the reference assets 144 is a set of common assets 146. Hence, a minimum set of needed speech assets for a TTS voice can be a set of the reference assets 144 minus the common assets 146. This set can be referred to as reduced assets 148. A relationship between the various types of speech assets is visually shown by Venn diagram 150.

A reduced script construction engine 160 can determine a set of needed TTS assets, which are not fulfilled by the pre-recorded assets 142. A reduced script 162 can be specifically constructed to generate the needed speech assets. More specifically, when a voice talent 172 reads the reduced script 162 in a recording environment 170, a reduced recording 180 can result, which when processed by the recognizer produces the reduced assets 148. Once a complete concatenative TTS voice is created it can be stored in a data store 190. A concatenative TTS engine 192 can use these stored voices to convert text 194 to speech 196.

As shown in system 100, the concatenative TTS engine 192 can be a speech engine of unlimited vocabulary that utilizes a unit selection synthesis technique. The techniques of leveraging pre-recorded audio 110 to reduce a size of a recording 180 read by a voice talent 172 can be adapted for a domain-specific synthesis technology in another contemplated embodiment of the disclosed invention.

The recognizer 130 can identify and create a database of speech assets 140 given sound recordings 110, 124, and/or 180 containing speech. In one embodiment, the recognizer 130 can be a speech recognizer set to a forced alignment mode. Speech technicians can optionally make manual corrections to assets 140, which have been automatically generated by the recognizer 130.

The speech assets 140 can include multiple phonetic trees of sound context data. Different ones of the phonetic trees can represent a sound's duration, power, and pitch (fundamental frequency). Speech assets 140 can also include acoustic parameters for a position in a syllable, a set of neighboring phones, and the like. At runtime, a desired target utterance can be created by the engine 192 by determining a best chain of candidate units for the text 194, which results in speech 196.

The reduced script construction engine 160 can be configured to enumerate the phonetic trees needed for a full concatenative TTS voice (e.g., reference assets 144) and to determine which of the enumerated assets are satisfied by the pre-recorded assets 142. All remaining unfulfilled assets are determined and engine 160 adds one or more phrases or sentences to the reduced script 162, which are designed to produce the unfulfilled assets when read and processed.

In one arrangement, the content placed in script 162 by engine 160 can be selected based upon content contained in the reference script 120. That is, when a script 162 entry is needed for an unfulfilled asset, the engine 160 can query a reference database to determine one or more phrases in the reference script 120 which is associated with the unfulfilled asset. The discovered phrase is added to the script 162 and a next unfulfilled asset is handled.

The engine 160 is not strictly limited to adding phrase-level units to the script 162. A size of the units added to script 162 can represent a tradeoff between script 162 size and performance. In one embodiment for example, word-level units can be added to the reduced script 162 to minimize a size of the script 162. This can have a negative consequence to a unit level synthesis asset set, specifically to units having at least a phrase-level size. In another example, sentence-level units can be added to the reduced script 162, which can result in a slightly better set of speech assets but a significantly larger script 162 size, in most circumstances, phrase-level unit additions to the reduced script 162 represent an optimal trade-off between performance and script size.

Figure 2:
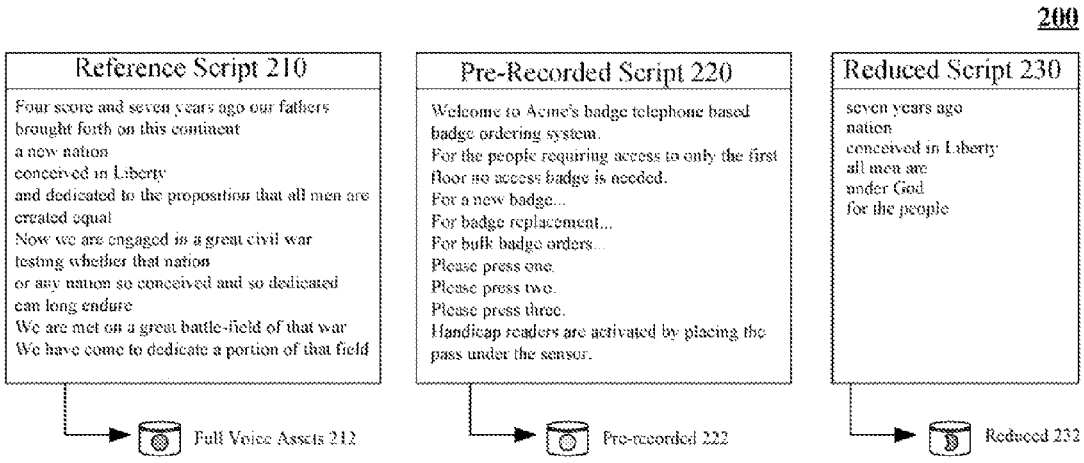
FIG. 2 is an illustrative scenario showing a reduced script which includes phrases obtained from a reference script in accordance with an embodiment of the inventive arrangements disclosed herein.

FIG. 2 is an illustrative scenario 200 showing a reduced script 230 which includes phrases obtained from a reference script 210, where the included phrases are able to generate a set of reduced speech assets 232 that when combined with pre-recorded assets 222 results in a full concatenative TTS voice (i.e., unit synthesis voice). The reduced script 230 is an example of a script 160 from system 100.

Scenario 200 assumes that a reference script 210 exists, which when recorded and processed through a recognizer results in a full set of voice assets 212, for sample purposes only, illustrated content of script 210 can include content from "The Gettysburg Address". The full set of voice assets 212 can include information specifying each arc (e.g., one third of a phoneme) along with values for pitch, duration, and power. For instance, for a given phoneme "p" proceeded by phoneme "o", and followed by phoneme "q", values for pitch, duration, and power can be specified.

The pre-recorded script 220 can be a script used to generate prompts of a speech user interface (SUI). A voice talent can read the script 220, which results in a recording from which the pre-recorded assets 222 are produced. The same voice talent can read the reduced script 230.

Once the pre-recorded assets 222 are generated, all "missing" acoustic values can be marked. Phrases from the reference script 210 that are associated with the missing acoustic values can be identified. These phrases can be placed in the reduced script 230. For example, the pre-recorded assets 222 can lack pitch, power, and/or duration values for a "g" after an "r" and before an "o." Searching script 210 can result in the phrase "under God" being found, which has the necessary acoustic characteristics that causes the phrase "under God" to be added to the reduced script 230.

In another example, the phrase(s) "four score and" from reference script 210 can include only phones-in-context which are redundant to phones-in-context obtained from the pre-recorded script 220. Thus, the pre-recorded assets 222 include ail assets that would be generated from a script 210 phrase of "four score and". Consequently, the phrase "four score and" would be omitted from the reduced script 230 which results in a small amount of savings in voice production costs. When a significant number of phrases are omitted, the cumulative savings in production costs can be substantial.

Figure 3A:
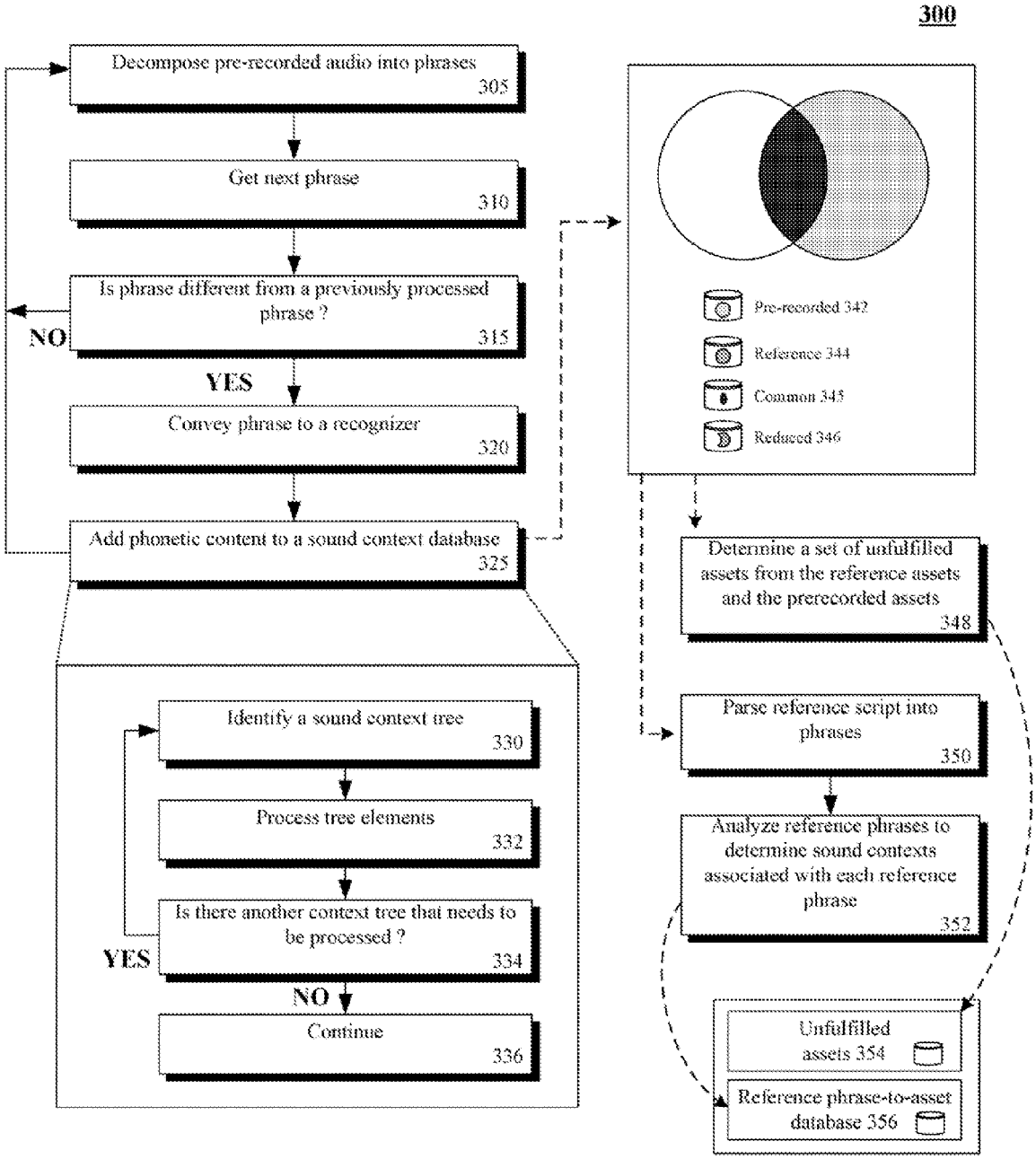
FIG. 3, which is formed from FIGS. 3A and 3B, is a flow chart of a method for constructing reduced script in accordance with an embodiment of the inventive arrangements disclosed herein.
Figure 3B:
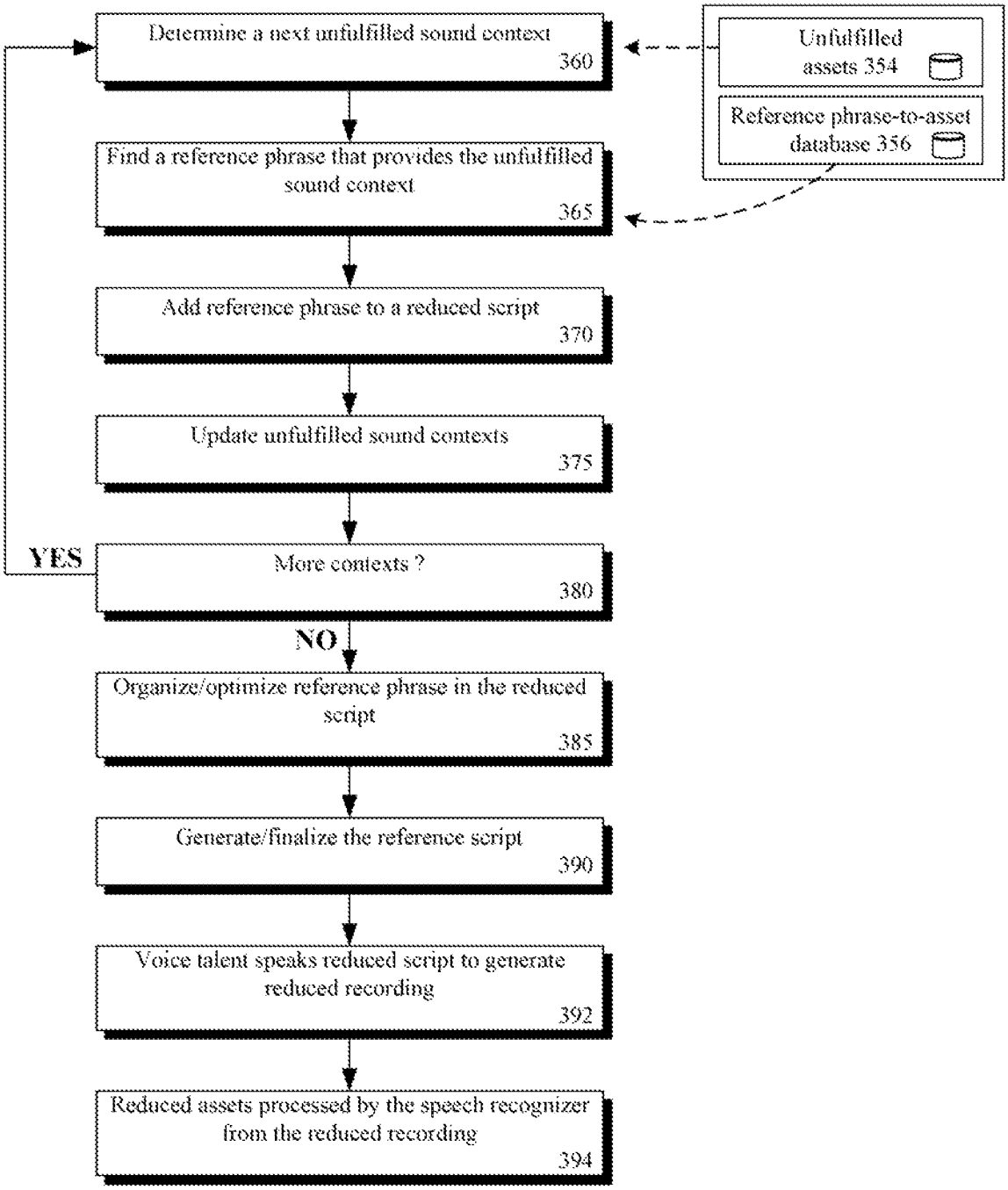

FIG. 3, which is formed from FIGS. 3A and 3B, is a flow chart of a method 300 for constructing reduced script in accordance with an embodiment of the inventive arrangements disclosed herein. Method 300 can be performed in a context of the system 100 or any similar system.

Method 300 can begin in step 305 where pre-recorded audio can be decomposed into a set of pre-recorded phrases. Step 310 can get a first one of these phrases. In step 315, a determination can be made as to whether the current phrase is different from a previously processed one. This step is performed to minimize unnecessary processing since the pre-recorded corpus is not specifically generated to create a concatenative TTS voice and therefore likely includes many redundant phrases for purposes of method 300. For example, the pre-recorded corpus can be a corpus generated from recorded phrases used by a SUI. When the current phrase contains phoneme characteristics of previously processed phrases, it can be skipped and the method can loop from step 315 to step 305, where a next pre-recorded phrase can be processed.

Otherwise, the method 300 can progress from step 315 to step 320 where the current phrase can be processed. Specifically, step 320 can convey the current phrase to a speech recognizer, which adds phonetic content extracted from the phrase to a sound context database as shown in step 325. When more unprocessed phrases exist, the method can loop from step 325 to step 310, where a next phrase can be retrieved.

Step 325 can include multiple sub-steps 330-336. The sub-steps 330-336 can result in a creation of a sound context database which includes information forming a pre-recorded set 342 of concatenative TTS assets. An intersection of the pre-recorded set 342 and a reference set 344 forms a common set 345. A union of the common set 345 and a reduced set 346 is a set of assets for full phonetic coverage (e.g., reference assets 344). The reduced set 346 can be automatically generated when a reduced recording is processed (i.e., step 394) by the speech recognizer. The reduced recording is created (i.e., step 392) when a voice talent reads a reduced script, which is generated by step 390.

In step 330, a data can be processed for a first phonetic context tree. Data elements for the context tree can be added to the database in step 332. Step 334 can determine if there is another context tree for which data needs to be processed. If not, the method can continue 336, which causes a loop to step 310, where a next phrase can be retrieved. When another context tree is to be processed, the method can loop from step 334 to step 330. Different context trees of the context sound database can represent a sound's duration, power, pitch, and the like.

Once steps 305-336 have executed for all phrases of the pre-recorded audio, the prerecorded assets 342 will be complete. A separate process can then execute which determines which sound contexts assets needed for a concatenative TTS voice remain unfulfilled 354, as shown by step 348.

Additionally, a reference script can be parsed into phrases, as shown in step 350. In step 352, each of these phrases can be analyzed to determine sound contexts associated with each reference phrase. These sound contexts and associated reference phrases can be stored in memory space 356.

Steps 360-390 (shown in FIG. 3B) can use information contained in the memory spaces 354-356 to generate a reduced script. In step 360, the memory space 354 can be queried to determine a next one of the unfulfilled sound context. In step 365, the memory space 356 can be searched to find a reference phrase that provides the unfulfilled sound context. Because the reference script is designed to result in complete phonetic coverage for a concatenative TTS voice, a phrase should exist in memory space 356 that satisfies each unfulfilled sound context of memory space 354.

The reference phrase resulting from the search can be added to a reduced script in step 370. Each reference phrase can include multiple phonemes and can resolve multiple unfulfilled sound contexts. Therefore, in step 375, the unfulfilled sound contexts can be updated in light of the newly added reference phrase. In one embodiment, the method 300 can be optimized to select reference phrases from the reference script in step 365 that resolve multiple ones of the unfulfilled sound contexts. When more unfulfilled sound context exist, the method can loop from step 380 to step 360, where a next unfulfilled sound context can be determined.

Otherwise, the method 300 can progress from step 370 through decision point 380 to step 385, where the reference phrases can be organized. The organization can be designed to group reference phrases in a similar manner as they existed in an original reference script. Thus, instead of having a series of disorganized words, the phrases can be arranged to make them easier for a voice talent to read. In one embodiment, when a majority of phrases for a sentence of the original reference script have been added to the reduced script, the missing words can be added to construct a complete sentence which again makes reading the reduced script easier. An optional optimization can also be performed to select phrases that satisfy the unfulfilled sound contexts 354, which will form complete sentences of the original reference script. In step 390, the reduced script can be generated which a voice talent reads in step 392 to create reduced corpus that is analyzed in step 394. The reduced assets 346 can them be combined with the common assets 345 to form a complete set of assets 344 for a TTS voice.

The present invention may be realized in hardware, software, or a combination of hardware and software. The present invention may be realized in a centralized fashion in one computer system or in a distributed fashion where different elements are spread across several interconnected computer systems. Any kind of computer system or other apparatus adapted for carrying out the methods described herein is suited. A typical combination of hardware and software may be a general purpose computer system with a computer program that, when being loaded and executed, controls the computer system such that it carries out the methods described herein.

The present invention also may be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

This invention may be embodied in other forms without departing from the spirit or essential attributes thereof. Accordingly, reference should be made to the following claims, rather than to the foregoing specification, as indicating the scope of the invention.

What is claimed is:

1. A method for generating a reduced script comprising:

automatically processing, by a speech recognizer, a pre-recorded audio to derive pre-recorded speech assets for a concatenative text-to-speech (TTS) voice;

determining, by a reduced script construction engine, unfulfilled speech assets needed for full phonetic coverage of the concatenative TTS voice, the unfulfilled speech assets determined from the pre-recorded speech assets and reference speech assets that are supposed to provide full phonetic coverage of the concatenative TTS voice; and constructing, by the reduced script construction engine, from the unfulfilled speech assets a reduced script that includes a set of phrases, for reading by a voice talent to provide a reduced recording, which when processed results in speech assets that include each of the unfulfilled speech assets.

2. The method of claim 1, further comprising:

identifying a reference script that includes reference phrases, wherein each of the phrases included in the reduced script is a reference phrase contained in the reference script.

3. The method of claim 2, further comprising:

associating each reference phrase in the reference script with reference speech assets that result from the associated phrase, when the phrase is spoken, recorded, and processed;

matching the unfulfilled speech assets against the reference speech assets; and adding phrases associated with matched reference speech assets to the reduced script.

4. The method of claim 2, further comprising:

associating each reference phrase in the reference script with reference speech assets that result from the associated phrase, when the phrase is spoken, recorded, and processed;

comparing reference speech assets of a reference phrase against the pre-recorded speech assets generated from the pre-recorded audio;

removing the reference phrase whenever all associated reference speech assets are contained in the pre-recorded speech assets generated from the pre-recorded audio; and repeating the comparing and removing steps for each phrase in the reference script, wherein the reduced script results from the repeated comparing and removing steps.

5. The method of claim 1, wherein the pre-recorded audio comprises a set of recorded phrases used by a speech user interface (SUI).

6. The method of claim 1, wherein the concatenative TTS voice is a unit selection synthesis concatenative TTS voice.

7. The method of claim 1, wherein the concatenative TTS voice is a domain-specific synthesis concatenative TTS voice.

8. The method of claim 1, wherein the pre-recorded speech assets include values for a plurality of phonetic context trees, said phonetic context trees including a pitch context tree, a duration context tree, and a power context tree.

9. A system for creating a concatenative TTS voice comprising:

a speech recognizer configured to generate a plurality of speech assets from audio recordings containing speech, wherein said speech recognizer receives pre-recorded audio and generates pre-recorded speech assets;

a reduced script construction engine configured to determine, from the pre-recorded speech assets and reference speech assets that provide full phonetic coverage of the concatenative TTS voice, unfulfilled speech assets and to construct from the unfulfilled speech assets a reduced script for reading by a voice talent to provide a reduced recording, wherein the reduced recording is processed to provide the unfulfilled speech assets.

10. The system of claim 9, wherein the pre-recorded speech assets include values for a plurality of phonetic context trees, said phonetic context trees including a pitch context tree, a duration context tree, and a power context tree.

11. The system of claim 9, wherein the reference speech assets are derived from a reference script, the reference script including a plurality of phrases, wherein the reference script is constructed so that when read, recorded, and processed, the reference speech assets are produced, wherein the reduced script consists of a subset of the plurality of phrases.

12. A method for concatenative text-to-speech (TTS) voice synthesis, comprising:

processing, by a speech recognizer, pre-recorded audio to derive pre-recorded speech assets;

receiving, by a reduced script construction engine, reference speech assets derived from a reference recording;

determining, by the reduced script construction engine, unfulfilled speech assets needed for full phonetic coverage, the unfulfilled speech assets determined from the pre-recorded speech assets and the reference speech assets;

constructing, by the reduced script construction engine, from the unfulfilled speech assets a reduced script to be read by a voice talent;

processing, by the speech recognizer, a reduced recording, recorded in response to reading of the reduced script by the voice talent, to determine reduced speech assets; and performing, by a concatenative TSS engine, concatenative TTS voice synthesis based on the pre-recorded voice assets and the reduced speech assets.

13. The method of claim 12, further comprising providing a reference script that includes reference phrases, wherein each of the phrases in the reduced script is a phrase contained in the reference script.

14. The method of claim 13, further comprising:

associating each reference phrase in the reference script with reference speech assets that result from the reference phrase;

matching the unfulfilled speech assets against the reference speech assets; and adding phrases associated with matched reference speech assets to the reduced script.

15. The method of claim 13, further comprising:

associating each reference phrase in the reference script with reference speech assets that result from the reference phrase;

comparing reference speech assets of a reference phrase with the pre-recorded speech assets;

removing the reference phrase when all associated reference speech assets are contained in the pre-recorded speech assets; and repeating the comparing and removing for each phrase in the reference script to provide the reduced script.

* * * * *